US010916141B1

(12) United States Patent
Wiesenberg

(10) Patent No.: US 10,916,141 B1
(45) Date of Patent: Feb. 9, 2021

(54) SYSTEM AND METHOD FOR GENERATING A PARKING SPACE DIRECTORY

(71) Applicant: Toyota Motor Engineering & Manufacturing North America, Inc., Plano, TX (US)

(72) Inventor: Ryan M. Wiesenberg, Ann Arbor, MI (US)

(73) Assignee: Toyota Motor Engineering & Manufacturing North America, Inc., Plano, TX (US)

( * ) Notice: Subject to any disclaimer, the term of this patent is extended or adjusted under 35 U.S.C. 154(b) by 0 days.

(21) Appl. No.: 16/719,137

(22) Filed: Dec. 18, 2019

(51) Int. Cl.
*G08G 1/14* (2006.01)

(52) U.S. Cl.
CPC ..... *G08G 1/143* (2013.01); *G08G 1/146* (2013.01)

(58) Field of Classification Search
None
See application file for complete search history.

(56) References Cited

U.S. PATENT DOCUMENTS

| | | | | |
|---|---|---|---|---|
| 7,679,727 | B2 | 3/2010 | Benz et al. | |
| 8,260,001 | B2 | 9/2012 | Jung | |
| 8,269,616 | B2 | 9/2012 | Uehara | |
| 8,300,889 | B2 | 10/2012 | Jung | |
| 8,692,688 | B1 | 4/2014 | Tuxen | |
| 9,140,553 | B2 | 9/2015 | Grimm et al. | |
| 9,177,475 | B2 | 11/2015 | Sellschopp | |
| 9,180,783 | B1 * | 11/2015 | Penilla | B60L 1/06 |
| 9,467,645 | B2 | 10/2016 | Yoon et al. | |
| 9,697,721 | B1 * | 7/2017 | Akuoku | G08B 21/0297 |
| 9,731,765 | B2 | 8/2017 | Yang | |
| 10,163,016 | B2 | 12/2018 | Hayakawa | |
| 10,169,993 | B1 * | 1/2019 | Dance | G08G 1/14 |
| 10,275,788 | B2 | 4/2019 | Wang | |
| 2006/0220911 | A1 | 10/2006 | Jaupitre et al. | |
| 2014/0062727 | A1 * | 3/2014 | Aivas | G08G 1/146 340/932.2 |
| 2016/0303990 | A1 * | 10/2016 | Penilla | G06F 3/04817 |
| 2016/0343139 | A1 | 11/2016 | Diegmann et al. | |
| 2017/0219361 | A1 * | 8/2017 | Mays | G01C 21/3685 |

(Continued)

FOREIGN PATENT DOCUMENTS

| | | | | |
|---|---|---|---|---|
| DE | 102017206311 | A1 | 10/2018 | |
| WO | WO-2018179956 | A1 * | 10/2018 | G08G 1/0969 |

*Primary Examiner* — Fekadeselassie Girma
(74) *Attorney, Agent, or Firm* — Christopher G. Darrow; Darrow Mustafa PC

(57) ABSTRACT

A system for generating a parking space directory includes at least one processor and a memory device in communication with the at least one processor. The memory device includes a communications module, a confidence interval module, and a directory generating module. The modules includes instructions that when executed by the one or more processors causes the one or more processors to obtain parking information related to at least one parking space having a vehicle parked within the at least one parking space, determine a confidence interval that the at least one parking space is an actual parking space based on a number of vehicles that have utilized the at least one parking space, and generate a directory of the at least one parking space that includes the location of the parking space and the confidence interval associated with the at least one parking space.

20 Claims, 3 Drawing Sheets

(56) References Cited

U.S. PATENT DOCUMENTS

| | | | | |
|---|---|---|---|---|
| 2018/0150764 | A1 | 5/2018 | Stenneth | |
| 2018/0215374 | A1 | 8/2018 | Lee et al. | |
| 2018/0321685 | A1 | 11/2018 | Yalla et al. | |
| 2018/0374349 | A1* | 12/2018 | Mowatt | G07B 15/02 |
| 2019/0050634 | A1* | 2/2019 | Nerayoff | G07B 15/00 |
| 2019/0064837 | A1 | 2/2019 | Miller et al. | |
| 2019/0118801 | A1 | 4/2019 | Noh et al. | |
| 2019/0147368 | A1 | 5/2019 | Pinel et al. | |
| 2019/0368880 | A1* | 12/2019 | Ma | G01C 21/12 |
| 2020/0004243 | A1* | 1/2020 | Wiesenberg | B60W 30/18154 |
| 2020/0035097 | A1* | 1/2020 | Tanizaki | G09B 29/00 |
| 2020/0211140 | A1* | 7/2020 | Horton | G06Q 10/047 |

* cited by examiner

SYSTEM AND METHOD FOR GENERATING A PARKING SPACE DIRECTORY

TECHNICAL FIELD

The subject matter described herein relates, in general, to systems and methods for generating a directory of parking spaces, especially nontraditional parking spaces.

BACKGROUND

The background description provided is to present the context of the disclosure generally. Work of the inventor, to the extent it may be described in this background section, and aspects of the description that may not otherwise qualify as prior art at the time of filing, are neither expressly nor impliedly admitted as prior art against the present technology.

Some parking spaces are "traditional" parking spaces that are well defined and are easily perceivable to the average driver that they are indeed parking spaces. These traditional parking spaces may be designated as parking spaces by the use of signs, lines delineating one or more parking spaces, purpose-built structures, or surface lots built solely for parking vehicles, etc. However, nontraditional parking spaces that are generally not known to the casual observer are more difficult to disseminate. "Nontraditional" parking spaces may be an open space that may not have the benefit of any signs, lines, or other markings, indicating that the open space can be utilized for parking a vehicle.

SUMMARY

This section generally summarizes the disclosure and is not a comprehensive explanation of its full scope or all its features.

In one embodiment, a system for generating a parking space directory includes at least one processor and a memory device in communication with the at least one processor. The memory device includes a communications module, a confidence interval module, and a directory generating module. The communications module includes instructions that when executed by the one or more processors causes the one or more processors to obtain parking information related to at least one parking space having a vehicle parked within the at least one parking space, wherein the parking information includes a location of a parking space. The confidence interval module includes instructions that cause the one or more processors to determine a confidence interval that the at least one parking space is an actual parking space based on a number of vehicles that have utilized the at least one parking space. The directory generating module includes instructions that cause the one or more processors to generate a directory of the at least one parking space that includes the location of the parking space and the confidence interval associated with the at least one parking space.

In another embodiment, a method for detecting at least one parking space includes the steps of obtaining parking information related to the at least one parking space having a vehicle parked within the at least one parking space, determining a confidence interval that the at least one parking space is an actual parking space based on a number of vehicles that have utilized the at least one parking space, and generating a directory of the at least one parking space.

The directory may include the location of the parking space and the confidence interval associated with the at least one parking space.

In yet another embodiment, a non-transitory computer-readable medium for detecting at least one parking space and including instructions that when executed by one or more processors cause the one or more processors to obtain parking information related to the at least one parking space having a vehicle parked within the at least one parking space, determine a confidence interval that the at least one parking space is an actual parking space based on a number of vehicles that have utilized the at least one parking space, and generate a directory of the at least one parking space. The directory may include the location of the parking space and the confidence interval associated with the at least one parking space.

Further areas of applicability and various methods of enhancing the disclosed technology will become apparent from the description provided. The description and specific examples in this summary are intended for illustration only and are not intended to limit the scope of the present disclosure.

BRIEF DESCRIPTION OF THE DRAWINGS

The accompanying drawings, which are incorporated in and constitute a part of the specification, illustrate various systems, methods, and other embodiments of the disclosure. It will be appreciated that the illustrated element boundaries (e.g., boxes, groups of boxes, or other shapes) in the figures represent one embodiment of the boundaries. In some embodiments, one element may be designed as multiple elements or multiple elements may be designed as one element. In some embodiments, an element shown as an internal component of another element may be implemented as an external component and vice versa. Furthermore, elements may not be drawn to scale.

DETAILED DESCRIPTION

A system and method for generating a directory of parking spaces may first obtain data regarding the presence of potential parking spaces from one or more devices. These potential parking spaces may be nontraditional parking spaces that do not have signs, parking lines, or other indicators indicating that they are parking spaces. The devices collecting data may include vehicles equipped with appropriate sensors for sensing potential parking spaces and/or the location of these potential parking spaces. However, the device does not necessarily need to be equipped within a vehicle and could be a mobile device, such as a mobile phone. This information may then be sent to a central server and/or other cloud based system.

The central server collects information regarding potential parking spaces and can determine a confidence interval regarding if the potential parking space is an actual parking space. For example, as more information comes in from more and more devices regarding potential parking spaces, the central server may be able to determine how often a vehicle is parked in the potential parking space and if more than one vehicle was parked in the potential parking space.

Based on this analysis, the central server can generate the confidence interval regarding if the potential parking space is an actual parking space.

The central server may be able to generate a directory of the parking spaces that may include the location of the parking space and/or the confidence interval regarding if the parking space is an actual parking space. The central server may also be able to send location information to other vehicles and/or devices that request the location of parking spaces located nearby. The central server may be configured such as to only provide information regarding parking spaces if the parking space has a sufficiently adequate confidence interval.

Figure 1:
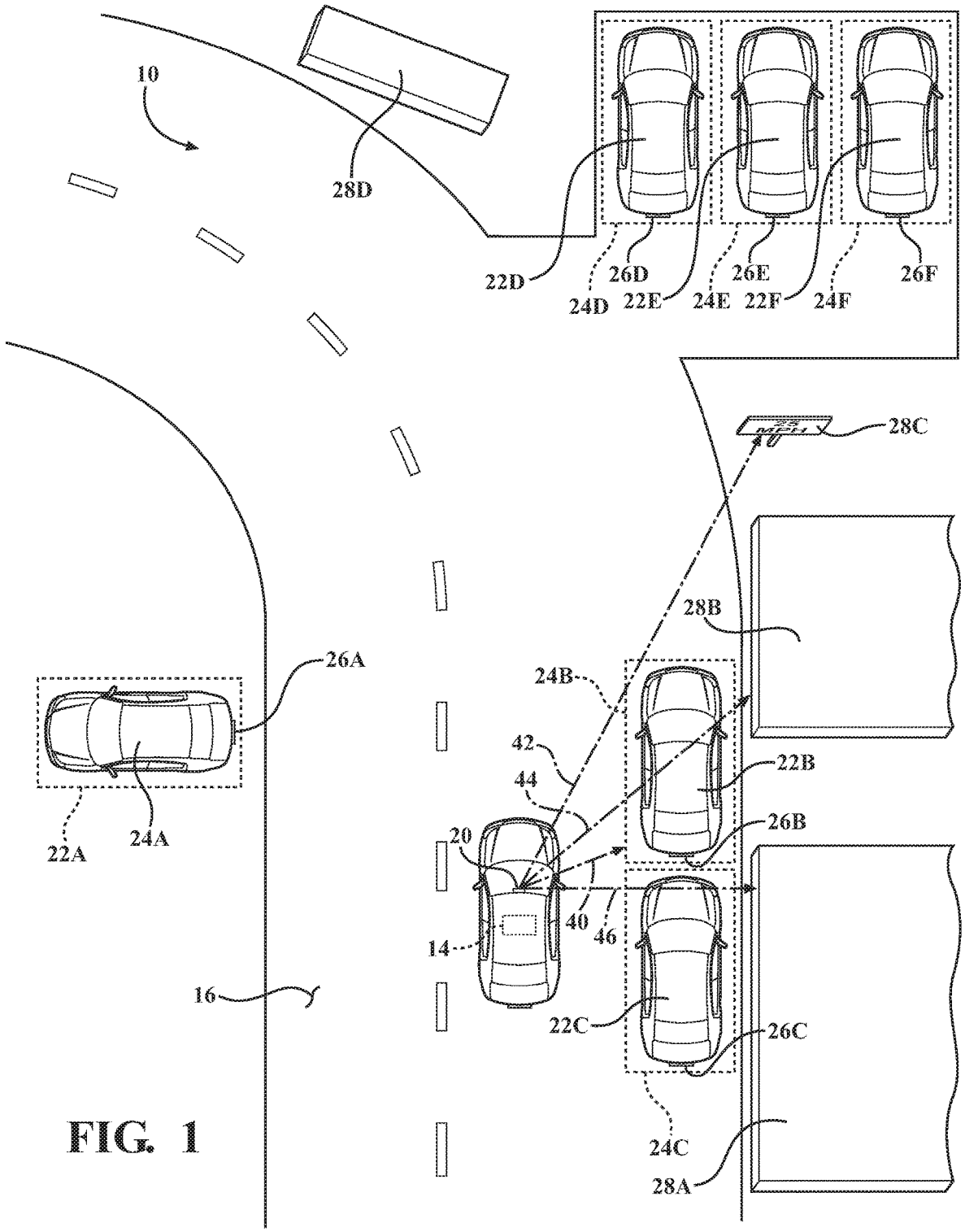
FIG. 1 illustrates a system for generating a directory of parking spaces operating in an environment.

Referring to FIG. 1, an environment 10 illustrating a vehicle 12 traveling along a road 16 is shown. The vehicle 12 may include a device 14 for generating a directory of parking spaces, such as nontraditional parking spaces that may be generally unknown to those unfamiliar with the area. These nontraditional parking spaces may be parking spaces that are understood to be parking spaces but do not contain any signage or other indicators indicating that they are parking spaces. As such, a person unfamiliar with the area may not be knowledgeable of the presence of these nontraditional parking spaces due to lack of familiarity with the area.

It should be understood that the vehicle 12 may be any one of several different types of vehicles capable of transporting persons or items from one location to another. In the example shown in FIG. 1, the vehicle 12 is in the form of an automobile. However, the vehicle 12 may take any one of several different forms, such as a truck, heavy-duty truck, tractor-trailer, tractor, mining vehicle, military vehicle, and the like.

As stated before, the vehicle 12 is traveling along a road 16. The environment 10 illustrates the presence of several nontraditional parking spaces. Moreover, the environment 10 includes a nontraditional parking space 24A located just off the side of the road 16, to the left of the vehicle 12. In addition, other nontraditional parking spaces are also present in the environment 10, such as parking spaces 24B and 24C located parallel to the direction of the road 16. These types of parking spaces may be considered parallel parking spaces but could also be considered non-traditional parking spaces, as there is no signage indicating that they are parking spaces.

Other parking spaces are also illustrated in this example. For example, these parking spaces could include parking spaces 24D-24F located at a nearby surface lot 25 that is adjacent to the road 16. Again, the lack of signage or any other indicator indicating that the parking spaces 24D-24F are indeed parking spaces would make it difficult for one unfamiliar with the area if a vehicle may be able to park in that parking space.

As a general overview, the device 14 may include a sensor system 20 that can determine the presence of one or more parking spaces within the environment 10. Here, as will be explained in greater detail later, the sensor system 20 may include any one of several different sensors capable of sensing the environment 10. For example, the sensor system 20 may include sensors such as one or more cameras, sonar sensors, radar sensors, LIDAR sensors, and the like. The sensor system 20 may also include other types of sensors, such as accelerometers, gyroscopes, compasses, and/or an RFID reader.

As the vehicle 12 is traveling down the road 16, the device 14 of the vehicle 12 detects the presence of several other vehicles, such as vehicles 22A-22F, using the sensor system 20. The sensor system 20, in one example, may capture one or more images of the vehicles 22A-22F that are parked in parking spaces 24A-24F, respectively. In addition to capturing images or other information regarding the vehicles 22A-22F, the sensor system 20 may also be able to collect identifying information of the vehicles 22A-22F. This identifying information could be visual identifying information, such as the make, model, and/or color of the vehicle. Additionally or alternatively, the identifying information could include information regarding specific identifying markers, such as license plates 26A-26F. Further, the vehicles 22A-22F may also be provided with other identifying systems, such as an RFID (radio frequency identification) tag or other like device that provides an identification of one or more of the vehicles 22A-22F via a wireless system. Again, there may be several different ways of identifying the vehicles 22A-22F, and it should not be limited to just those discussed above and/or combinations thereof.

The sensor system 20 may also be able to capture location information regarding one or more structures in the environment 10. For example, the structures could include buildings, such as buildings 28A, 28B, and/or 28D, but also other smaller structures, such as fences, bushes, trees, lamp posts, rocks, signs, such as sign 28C, and/or other freestanding structures. The device 14 may be able to determine the relative location of the parking spaces 24A-24F by using other objects as reference objects. For example, the device 14 using the sensor system 20 may be able to detect the location of buildings 28A, 28B, and/or 28C and use those structures as a reference to determine the reference location of the parking space 24B. This information may also be combined with information from the vehicle 12, which may include location information derived from a Global Navigation Satellite System ("GNSS") which will be described later in this disclosure.

The location of a parking space may be determined using any one of several different structures as reference objects. Moreover, in some examples, only two reference objects may be necessary to determine the relative location of a parking space. For example, the device 14 using information from the sensor system 20 may be able to determine the relative distances 42, 44, and/or 46 to objects 28C, 28B, and 28A, respectively. In addition, the device 14 using information from the sensor system 20 may be able to determine the distance 42 the parked vehicle 22B and/or the parking space 24B. Based on the distances 42, 44, and/or 46 and the distance 40, the device 14 may be able to determine the relative location of the parking space 24B and/or the vehicle 22B. The location of the parking space 24B and/or the distance 40 to the parking space 24B may be determined by performing a direct measurement to the parking space 24B or may be determined by performing a measurement of the general location of the vehicle 22B. The parking space 24B may be determined by essentially providing a buffer area around the vehicle 22B to define the parking space 24B. Of course, it should be understood that any one several different methodologies may be utilized to determine the location of the parking space 24B. Information from the vehicles GNSS system may also be utilized in combination with the distances 40, 42, 44, and/or 46 to determine the relative location of the vehicle 22B and/or the parking space 24B.

Further, as stated before, any one of several different methodologies could be utilized to determine the location of the vehicle 22B and/or the parking space 24B. In one example, only one reference object may be utilized along with edge detection to establish an X, Y position. Further, one reference object along with a direction identifier can be used, either from an onboard compass reading or through known algorithms that calculate direction from sun or star positions.

Information collected by the device 14 may then be sent to a central server for processing and/or distribution to other vehicles or devices. However, while a central server may be utilized, the device 14 may instead perform some or all the functions performed by the central server. As will be explained in greater detail later in this description, the central server collects information received from the device 14 and can generate a confidence interval if the parking space, such as parking spaces 24A-24F are actual parking spaces. This confidence interval may be based how often a vehicle is parked in the parking spaces 24A-24F, the number of different vehicles that have utilized the parking spaces 24A-24F, and other information.

Figure 2:
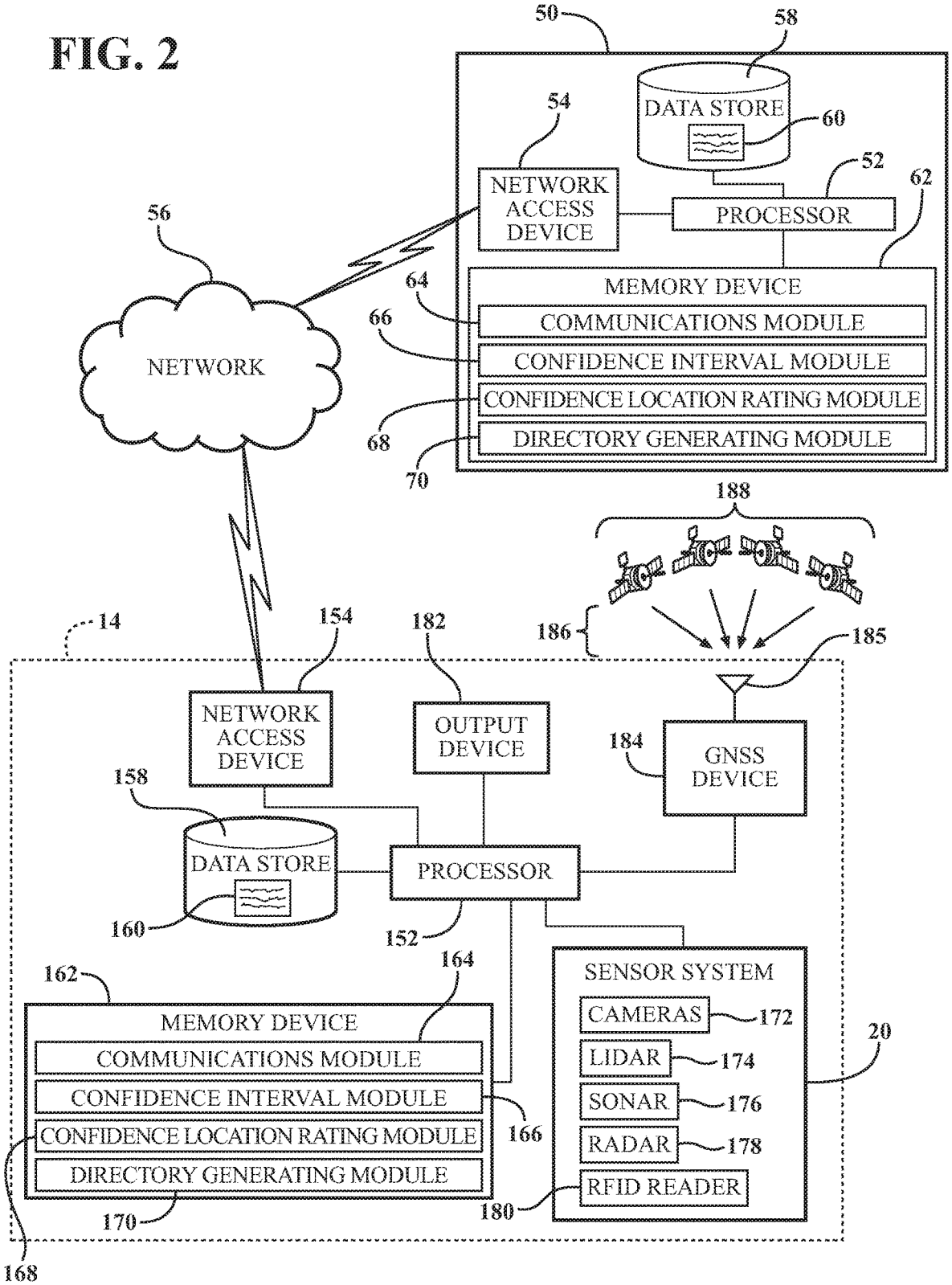
FIG. 2 illustrates a block diagram of a system for generating a directory of parking spaces.

Referring to FIG. 2, a more detailed view of the device 14 of the vehicle 12 and a central server 50 is shown. With regards to the central server 50, the central server 50 may include a processor 52. The processor 52 may be a single processor or may be multiple processors working in concert. In addition, the processor 52 may be distributed across different systems located external to the central server 50. For example, the processor 52 may include other processors, such as a processor located within the device 14 of the vehicle 12. The central server 50 may be a cloud based system.

A network access device 54 is in communication with the processor 52 and allows the processor 52 to communicate with a network 56. The network access device 54 could include any one of several different hardware components that allow for the communication of the processor 52, and therefore the central server 50, with the network 56. The network access device 54 of the central server 50 may be in communication with the network 56 through a wired and/or wireless communication link. Further still, the network access device 54 may utilize any one of several different communication protocols to communicate with the network 56.

The network 56 may be any type of network. In one example, the network 56 may be a distributed network, such as the Internet. However, any type of network may be utilized.

The processor 52 may also be in communication with a data store 58. The data store 58 is, in one embodiment, an electronic data structure such as a database that is stored in a memory and that is configured with routines that can be executed by the processor 52 for analyzing stored data, providing stored data, organizing stored data, and so on. Thus, in one embodiment, the data store 58 stores data used by the processor 52 in executing various functions. The data store 58 may store a directory 60 of parking spaces generated by the central server 50 and/or the device 14.

The processor 52 may also be in communication with a memory device 62. The memory device 62 may be any type of memory capable of storing information that can be utilized by the processor 52. As such, the memory device 65 may be a solid-state memory device, magnetic memory device, optical memory device, combinations thereof, and the like. In this example, the memory device 62 is separate from the processor 52, but it should be understood that the memory device 62 may be incorporated within the processor 52, as opposed to being a separate device. It should also be understood that the data store 58 and the memory device 62 may be separate components as shown or may be combined. Furthermore, the data store 58 and/or the memory device 62 may utilize several different memory storage systems across various systems, even systems outside the central server 50.

The memory device 62 may include one or more modules that cause the processor 52 to perform any one of the methodologies described in this specification. In one example, the memory device 62 includes a communications module 64, a confidence interval module 66, a confidence location rating module 68, and/or a directory generating module 70.

With regards to the communications module 64, the communications module 64 causes the processor 52 to communicate with the device 14 via the network 56 using the network access device 54. In one example, the communications module 64 causes the processor 52 to obtain parking information related to at least one parking space having a vehicle parked within the at least one parking space. The parking information includes a location of a parking space. In one example, referring to FIG. 1, the processor 52 obtains parking-related information from the device 14. The parking-related information could include information regarding the location of parked vehicles 22A-22F and/or parking spaces 24A-24F. The parking-related information could include identifying characteristics of the vehicles 22A-22F. These identifying characteristics could include information regarding the color, make and/or model of each of the vehicles 22A-22F. In addition, the identifying characteristics could include other identifying information, such as license plate information obtained from the license plates 26A-26F or other information obtained by the sensor system 20 of the device 14 as the vehicle 12 passes near the vehicles 22A-22F.

As stated before, the location of the vehicles 22A-22F and/or the parking spaces 24A-24F could be determined by utilizing one or more reference objects, such as buildings 28A, 28B, and/or 28D. Other objects can also be utilized as reference objects such as fences, bushes, trees, lamp posts, rocks, and signs, such as the sign 28C. Based on the distances and/or relative positions of one or more of the objects 28A-28D, the general X, Y the locations of the vehicles 22A-22F and/or the parking spaces 24A-24F may be determined.

The confidence interval module 66 causes the processor 52 to generate a confidence interval indicating that a parking space, such as parking spaces 24A-24F, are indeed actual parking spaces. A number of different methodologies could be utilized to determine the confidence interval. For example, the confidence interval module 66 may cause the processor 52 to determine that a parking space is more likely to be an actual parking space if it is determined that different vehicles have utilized the parking space over a period of time. For example, utilizing identifying information, such as the make, model, color, and/or license plate information from license plates 26A-26F, the processor 52 can determine how many different vehicles have parked in the potential parking space.

Generally, the more different vehicles that are parked in a potential parking space indicates that the potential parking space is an actual parking space. As more and more data is collected for more and more vehicles having the device 14, the confidence interval can be increased if it is discovered that many different vehicles are utilizing the potential parking space. Conversely, if it is determined that only one vehicle utilizes the potential parking space or that the potential parking space is rarely if ever occupied, the confidence interval may be lowered indicating that the potential parking spaces less likely to be a parking space.

The confidence interval may also be based on the amount of time and occurrences that the device 14 has been able to observe the potential parking space. As more observations of the potential parking space are performed, the confidence interval can be appropriately adjusted. As such, if the potential parking spaces only been observed by the device 14 only once, the confidence interval may be lowered as opposed to a parking space that has been observed numerous times.

The confidence location rating module 68 may cause the processor 52 to generate a confidence rating regarding the location of at least one parking space. As stated before, the location of the parking space, such as the parking spaces 24A-24F may be based on utilizing one or more reference objects, such as buildings 28A, 28B, and/or 28D or other objects, such as the sign 28C. The confidence rating regarding the location of at least one parking space may be based on the type of object that is being utilized as a reference object. For example, if the object is a building, the confidence rating may be higher than if the object is a much smaller object, such as a road sign.

Generally, the use of reference objects that are more permanent in nature, such as buildings, large structures, and other objects that are difficult to move, will be given greater weight and therefore will generate a higher confidence location rating. Smaller objects, such as road signs, construction barriers, small buildings, and other more easily moved or removed objects, will generate a lower confidence location rating. As such, reference objects may be divided up into separate object classes. In one example, the object class may include an infrastructure class, a fixed structure class, and a dynamic structure class. The infrastructure class could include large objects that may be occupied by persons and/or vehicles. As such, the infrastructure class may include buildings, parking structures, homes, and other large structures. The fixed structure class may relate to smaller structures that are generally fixed in nature, such as signs, fences, and the like. The fixed structure class differs from the infrastructure class and that the fixed structure class cannot be occupied by persons and/or vehicles. The dynamic structure class may be large objects that are unlikely to move but are movable. This class of objects may include objects that are fixed for long periods of time, such as building cranes, temporary public art, and the like.

The confidence location rating can also be impacted by the number of different vehicles that have the device 14 that have detected the location of the parking space. As more and more vehicles detect the location of the parking space, the confidence location rating can also be increased as well.

The directory generating module 70 may cause the processor 52 to generate a directory, such as a directory 60 which is stored in the data store 58. The directory 60 may include the location of the parking space, the confidence interval indicating that the parking space is an actual parking space, the confidence location rating, and/or other information related to the parking space. The directory 60 may be constantly updated as more information is gathered from other vehicles containing the device 14.

The central server 50 may also perform other functions outside of those functions described above. For example, the central server 50 may also perform functions relating to disseminating information located within the directory 60. In one example, vehicles, such as the vehicle 12, but also vehicles 22A-22F, or any other vehicle with the ability to communicate with the central server 50, may be able to request from the central server 50 information regarding the location of any parking spaces near the requesting vehicle. For example, referring to FIG. 1, the vehicle 12 may communicate with the central server 50 by the network 56 and may request information regarding location of any parking spaces, including nontraditional parking places that have been stored in the directory 60. The central server 50 can disseminate this information to the vehicle 12 based on a specific request from the operator the vehicle 12, the location of the vehicle 12, or other information from the vehicle 12. This information can then be provided to the vehicle 12 so that the operator or an autonomous vehicle system, can utilize one of the parking spaces provided by the central server 50.

As stated before, while the central server 50 may include the functionality of generating the directory 60, it should be also understood that any of the functions of the central server 50 could also be performed by the device 14. For example, referring back to FIG. 2, the device 14 may include a processor 152 that may be a standalone processor or may be multiple processors working in concert. Similar to the processor 52, the processor 152 may be located within the device 14 or may be located outside the device 14.

The processor 152 is connected to a network access device 154 that, like the network access device 54, may include hardware that allows the processor 152 to communicate with the network 56 and other devices connected to the network 56, such as the central server 50. The network access device 156 may also be in communication with an antenna that allows the network access device to communicate with the network 56 via a wireless communication protocol.

The device 14 may also include a data store 158 that is capable of storing information that may be similar to the data store 58 of the central server 50. In this example, the data store 158 also stores a directory 160 of parking spaces. It should be understood that the device 14 may not include the data store 158 and may instead rely on the data store 58 of the central server 50.

The device 14 may also include a sensor system 20 that is in communication with the processor 152. In this example, the sensor system 20 may include any one of several different sensors capable of sensing the environment surrounding the vehicle 12. In this example, the sensor system 20 includes one or more cameras 172 that may be utilized to sense objects located within the environment 10, such as the vehicles 22A-22F, the objects 28A-28D, and any other objects and/or vehicles located within the environment that the vehicle 12 operates within.

In addition to or as an alternative to cameras 172, the sensor system 20 may also include a LIDAR sensor 174, a sonar sensor 176, a radar 178, and/or an RFID reader 180 that may be utilized to read RFID related information. As stated before, the vehicles 22A-22F may include RFID devices that allow the RFID reader 180 to receive information from the RFID devices. This information could include identifying information identifying the vehicles 22A-22F.

A memory device 162 may also be in communication with the processor 152. In this example, the memory device 162 also includes a communications module 164, a confidence interval module 166, a confidence location rating module 168, and/or a directory generating module 170. The description of the memory device 162 may be similar to the memory device 62 of the central server 50. In like manner, the modules 164, 166, 168, and 170 may also be similar to the modules 64, 66, 68, and 70, respectively. As such, no further description will be given, as the prior description is equally applicable here.

The device 14 may also include a GNSS system 184. The GNSS system 184 may be a satellite navigation system that provides autonomous geo-spatial positioning with global coverage. The GNSS system 184 may include any one of a number of different GNSS systems, such as GPS, GLONASS, Galileo, Beidou or other regional systems. The GNSS system 184 may be connected to an antenna 185 that is capable of receiving one or more signals 186 from one or more satellites 188. Based on the one or more signals 186 from one or more satellites 188, the GNSS system 184 is able to determine the relative location of the device 14 to which the GNSS system 184 is installed. This relative location may be in the form of a coordinate system that may indicate the latitude, longitude, and/or altitude of a vehicle that has the GNSS system 184 installed within.

An output device 182 may also be in communication with the processor 152. The output device 182 may be any type of device that allows the driver to receive information from the one or more processors 152 of the device 14. In one example, the output device 182 may be a visual or audible output device that made communicate to the driver the location of one or more parking spaces from the directory 60 or 160.

Figure 3:
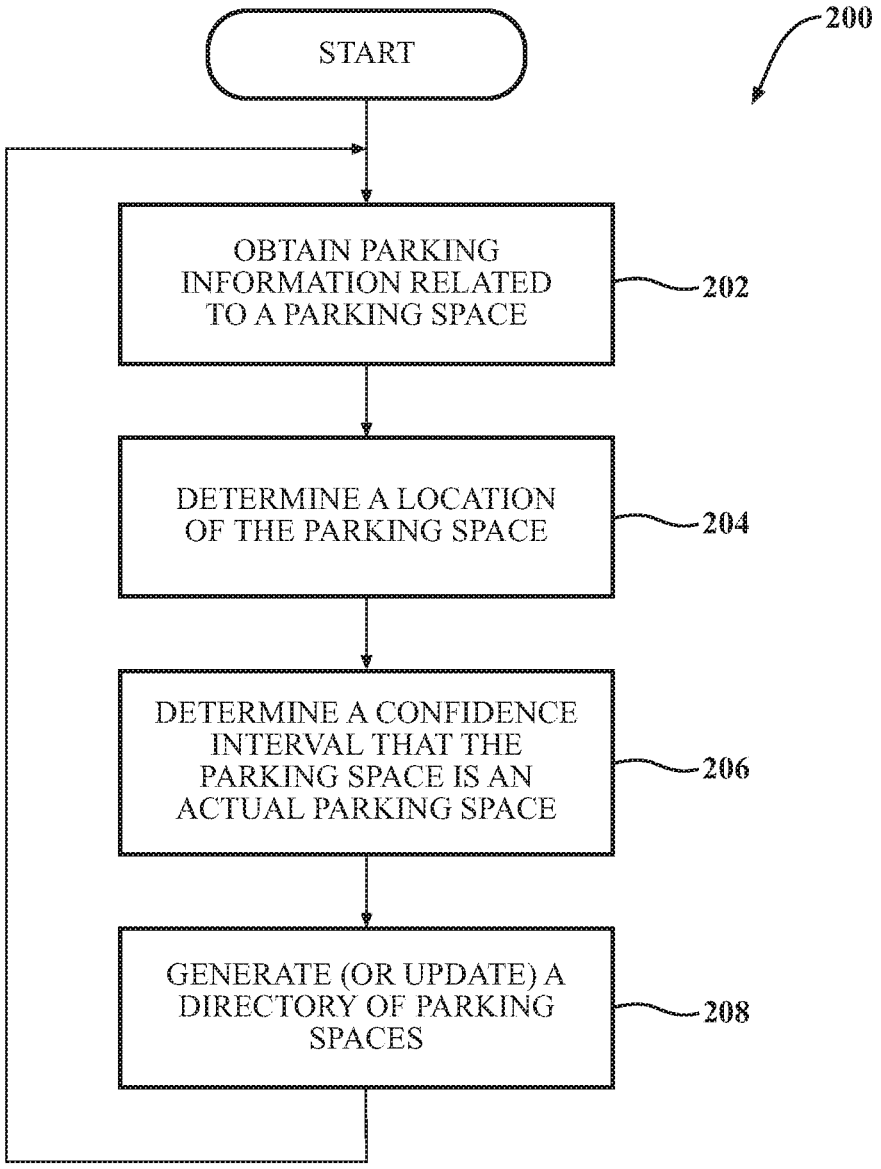
FIG. 3 illustrates a method for generating a directory of parking spaces.

Referring to FIG. 3, a method 200 for generating a directory, such as the directory 60 or 160 of FIG. 2 is shown. Here, the method 200 will be described from the viewpoint of the central server 50 of FIG. 2. However, it should be understood that this is just but one implementation of practicing the method 200.

In step 202, the communications module 64 causes the processor 52 of the central server 50 to obtain parking-related information related to a parking space. The parking-related information could include information regarding the location of the parking space, a description of the vehicle located within the parking space, such as color, make, model, license plate information, or other identifying information, and how the location of the parking space was determined. For example, was the parking space location determined by using several reference objects, a single reference objects, and the class of reference objects that were utilized to determine the location of the parking space. The information obtained in step 202 may have been generated by the device 14 that may be installed within a vehicle 12. However, should be understood that the device 14 may be installed in other types of devices, such as a mobile phone.

In step 204, the directory generating module 70 may cause the processor 52 to determine the location of the parking space. It should be understood that the determination of the parking space may already have been determined by the device 14 and provided to the central server 50 in the previous step. However, the processor 52 may also be able to determine the location of the parking space based on information provided to the processor 52 in step 202.

In step 206, the confidence interval module 66 causes the processor 52 to generate a confidence interval that the parking space is an actual parking space.

A number of different methodologies could be utilized to determine the confidence interval. For example, the confidence interval module 66 may cause the processor 52 to determine that a parking space is more likely to be an actual parking space if it is determined that different vehicles have utilized the parking space over a period of time. For example, utilizing identifying information, such as the make, model, color, and/or license plate information from license plates 26A-26F, the processor 52 can determine how many different vehicles have parked in the potential parking space.

Generally, the more different vehicles that are parked in a potential parking space indicates that the potential parking space is an actual parking space. As more and more data is collected for more and more vehicles having the device 14, the confidence interval can be increased if it is discovered that many different vehicles are utilizing the potential parking space. Conversely, if it is determined that only one vehicle utilizes the potential parking space or that the potential parking space is rarely if ever occupied, the confidence interval may be lowered indicating that the potential parking spaces less likely to be a parking space.

The confidence interval may also be based on the amount of time and occurrences that the device 14 has been able to observe the potential parking space. As more observations of the potential parking space are performed, the confidence interval can be appropriately adjusted. As such, if the potential parking spaces only been observed by the device 14 only once, the confidence interval may be lowered as opposed to a parking space that has been observed numerous times.

Other confidence related information may also be generated in step 206. For example, the confidence location rating module 68 may cause the processor 52 to generate a confidence rating regarding the location of at least one parking space. As stated before, the location of the parking space, such as the parking spaces 24A-24F may be based on utilizing one or more reference objects, such as buildings 28A, 28B, and/or 28D or other objects, such as the sign 28C. The confidence rating regarding the location of at least one parking space may be based on the type of object that is being utilized as a reference object. For example, if the object is a building, the confidence rating may be higher than if the object is as much smaller object, such as a road sign.

Generally, the use of reference objects that are more permanent in nature, such as buildings, large structures, and other objects that are difficult to remove, will be given greater weight and therefore will generate a higher confidence location rating. Smaller objects, such as road signs, construction barriers, small buildings, and other more easily moved or removed objects, will generate a lower confidence location rating. As such, reference objects may be divided up into separate object classes. In one example, the object class may include an infrastructure class, a fixed structure class, and a dynamic structure class. The infrastructure class could include large objects that may be occupied by persons and/or vehicles. As such, the infrastructure class may include buildings, parking structures, homes, and other large structures. The fixed structure class may relate to smaller structures that are generally fixed in nature, such as signs, fences, and the like. The fixed structure class differs from the infrastructure class and that the fixed structure class cannot be occupied by persons and/or vehicles. The dynamic structure class may be large objects that are unlikely to move but are movable. This class of objects may include objects that are fixed for long periods of time, such as building cranes, temporary public art, and the like.

The confidence location rating can also be impacted by the number of different vehicles that have the device 14 that have detected location of the parking space. As more and more vehicles detect the location of the parking space, the confidence location rating can also be increased as well.

In step 208, the directory generating module 70 may cause the processor 52 to generate a directory, such as a directory 60 which is stored in the data store 58. The directory 60 may include the location of the parking space, the confidence interval indicating that the parking space is an actual parking space, the confidence location rating, and/or other information related to the parking space. The directory 60 may be constantly updated as more information is gathered from other vehicles containing the device 14.

It should be appreciated that any of the systems described in this specification can be configured in various arrangements with separate integrated circuits and/or chips. The circuits are connected via connection paths to provide for communicating signals between the separate circuits. Of course, while separate integrated circuits are discussed, in various embodiments, the circuits may be integrated into a common integrated circuit board. Additionally, the integrated circuits may be combined into fewer integrated circuits or divided into more integrated circuits.

In another embodiment, the described methods and/or their equivalents may be implemented with computer-executable instructions. Thus, in one embodiment, a non-transitory computer-readable medium is configured with stored computer executable instructions that when executed by a machine (e.g., processor, computer, and so on) cause the machine (and/or associated components) to perform the method.

While for purposes of simplicity of explanation, the illustrated methodologies in the figures are shown and described as a series of blocks, it is to be appreciated that the methodologies are not limited by the order of the blocks, as some blocks can occur in different orders and/or concurrently with other blocks from that shown and described. Moreover, less than all the illustrated blocks may be used to implement an example methodology. Blocks may be combined or separated into multiple components. Furthermore, additional and/or alternative methodologies can employ additional blocks that are not illustrated.

Detailed embodiments are disclosed herein. However, it is to be understood that the disclosed embodiments are intended only as examples. Therefore, specific structural and functional details disclosed herein are not to be interpreted as limiting, but merely as a basis for the claims and as a representative basis for teaching one skilled in the art to variously employ the aspects herein in virtually any appropriately detailed structure. Further, the terms and phrases used herein are not intended to be limiting but rather to provide an understandable description of possible implementations.

The flowcharts and block diagrams in the figures illustrate the architecture, functionality, and operation of possible implementations of systems, methods, and computer program products according to various embodiments. In this regard, each block in the flowcharts or block diagrams may represent a module, segment, or portion of code, which comprises one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved.

The systems, components and/or processes described above can be realized in hardware or a combination of hardware and software and can be realized in a centralized fashion in one processing system or in a distributed fashion where different elements are spread across several interconnected processing systems. Any kind of processing system or another apparatus adapted for carrying out the methods described herein is suited. A combination of hardware and software can be a processing system with computer-usable program code that, when being loaded and executed, controls the processing system such that it carries out the methods described herein. The systems, components and/or processes also can be embedded in a computer-readable storage, such as a computer program product or other data programs storage device, readable by a machine, tangibly embodying a program of instructions executable by the machine to perform methods and processes described herein. These elements also can be embedded in an application product which comprises all the features enabling the implementation of the methods described herein and, which when loaded in a processing system, is able to carry out these methods.

Furthermore, arrangements described herein may take the form of a computer program product embodied in one or more computer-readable media having computer readable program code embodied, e.g., stored, thereon. Any combination of one or more computer-readable media may be utilized. The computer-readable medium may be a computer readable signal medium or a computer-readable storage medium. The phrase "computer-readable storage medium" means a non-transitory storage medium. A computer-readable medium may take forms, including, but not limited to, non-volatile media, and volatile media. Non-volatile media may include, for example, optical disks, magnetic disks, and so on. Volatile media may include, for example, semiconductor memories, dynamic memory, and so on. Examples of such a computer-readable medium may include, but are not limited to, a floppy disk, a flexible disk, a hard disk, a magnetic tape, other magnetic medium, an ASIC, a graphics processing unit (GPU), a CD, other optical medium, a RAM, a ROM, a memory chip or card, a memory stick, and other media from which a computer, a processor or other electronic device can read. In the context of this document, a computer-readable storage medium may be any tangible medium that can contain or store a program for use by or in connection with an instruction execution system, apparatus, or device.

The following includes definitions of selected terms employed herein. The definitions include various examples and/or forms of components that fall within the scope of a term, and that may be used for various implementations. The examples are not intended to be limiting. Both singular and plural forms of terms may be within the definitions.

References to "one embodiment", "an embodiment", "one example", "an example", and so on, indicate that the embodiment(s) or example(s) so described may include a particular feature, structure, characteristic, property, element, or limitation, but that not every embodiment or example necessarily includes that particular feature, structure, characteristic, property, element or limitation. Furthermore, repeated use of the phrase "in one embodiment" does not necessarily refer to the same embodiment, though it may.

"Module," as used herein, includes a computer or electrical hardware component(s), firmware, a non-transitory computer-readable medium that stores instructions, and/or combinations of these components configured to perform a function(s) or an action(s), and/or to cause a function or action from another logic, method, and/or system. Module may include a microprocessor controlled by an algorithm, a discrete logic (e.g., ASIC), an analog circuit, a digital circuit, a programmed logic device, a memory device including instructions that when executed perform an algorithm, and so on. A module, in one or more embodiments, may include one or more CMOS gates, combinations of gates, or other circuit components. Where multiple modules are described, one or more embodiments may include incorporating the multiple modules into one physical module component. Similarly, where a single module is described, one or more embodiments distribute the single module between multiple physical components.

Additionally, module, as used herein, includes routines, programs, objects, components, data structures, and so on that perform tasks or implement data types. In further aspects, a memory generally stores the noted modules. The memory associated with a module may be a buffer or cache embedded within a processor, a RAM, a ROM, a flash memory, or another suitable electronic storage medium. In still further aspects, a module as envisioned by the present disclosure is implemented as an application-specific integrated circuit (ASIC), a hardware component of a system on a chip (SoC), as a programmable logic array (PLA), as a graphics processing unit (GPU), or as another suitable hardware component that is embedded with a defined configuration set (e.g., instructions) for performing the disclosed functions.

In one or more arrangements, one or more of the modules described herein can include artificial or computational intelligence elements, e.g., neural network, fuzzy logic, or other machine learning algorithms. Further, in one or more arrangements, one or more of the modules can be distributed among a plurality of the modules described herein. In one or more arrangements, two or more of the modules described herein can be combined into a single module.

Program code embodied on a computer-readable medium may be transmitted using any appropriate medium, including but not limited to wireless, wireline, optical fiber, cable, RF, etc., or any suitable combination of the foregoing. Computer program code for carrying out operations for aspects of the present arrangements may be written in any combination of one or more programming languages, including an object-oriented programming language such as Java™, Smalltalk, C++ or the like and conventional procedural programming languages, such as the "C" programming language or similar programming languages. The program code may execute entirely on the user's computer, partly on the user's computer, as a stand-alone software package, partly on the user's computer and partly on a remote computer, or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

The terms "a" and "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The phrase "at least one of . . . and . . . " as used herein refers to and encompasses any and all possible combinations of one or more of the associated listed items. As an example, the phrase "at least one of A, B, and C" includes A only, B only, C only, or any combination thereof (e.g., AB, AC, BC or ABC).

Aspects herein can be embodied in other forms without departing from the spirit or essential attributes thereof. Accordingly, reference should be made to the following claims, rather than to the foregoing specification, as indicating the scope hereof.

What is claimed is:

1. A system for generating a parking space directory of nontraditional parking spaces, the system comprising:

at least one processor;

a memory device in communication with the at least one processor, the memory device having a communications module having instructions that when executed by the one or more processors causes the one or more processors to obtain parking information related to at least one nontraditional parking space having a vehicle parked within the at least one nontraditional parking space, wherein the parking information includes a location of the at least one nontraditional parking space;

the memory device having a confidence interval module, the confidence interval module having instructions that when executed by the one or more processors causes the one or more processors to determine a confidence interval that the at least one nontraditional parking space is an actual parking space based on a number of vehicles that have utilized the at least one nontraditional parking space;

the memory device having a directory generating module, the directory generating module having instructions that when executed by the one or more processors causes the one or more processors to generate a directory of the at least one nontraditional parking space, the directory including the location of the parking space and the confidence interval associated with the at least one nontraditional parking space; and wherein the at least one nontraditional parking space is a parking space for a vehicle that does not have an indicator indicating that the at least one nontraditional parking space is an actual parking space.

2. The system of claim 1, wherein the communications module further includes instructions that when executed by the one or more processors causes the one or more processors to transmit the location of the at least one nontraditional parking space and the confidence interval associated with the at least one nontraditional parking space to a vehicle.

3. The system of claim 1, wherein the directory generating module further includes instructions that when executed by the one or more processors causes the one or more processors to determine a first reference location of a first reference object, determine a second reference location of a second reference object, and determine the location of the at least one nontraditional parking space based on the first reference location and the second reference location.

4. The system of claim 3, wherein the memory device further includes a confidence location rating module having instructions that when executed by the one or more processors causes the one or more processors to determine a confidence location rating of the location of the at least one nontraditional parking space based on an object class of the first reference object or the second reference object, wherein the confidence location rating indicates a likelihood that the location of the at least one nontraditional parking space is correct.

5. The system of claim 4, wherein the object class includes at least one of an infrastructure class, a fixed structure class, and a dynamic structure class.

6. The system of claim 1, wherein the parking information includes an identifier identifying the vehicle parked within the at least one nontraditional parking space.

7. The system of claim 6, wherein the confidence interval module further includes instructions that when executed by the one or more processors causes the one or more processors to determine the confidence interval based on a number of different vehicles that have utilized the at least one nontraditional parking space.

8. The system of claim 1, further comprising a sensor in communication with the processor, the sensor being configured to capture images of the at least one nontraditional parking space having a vehicle parked within the at least one nontraditional parking space.

9. A method for detecting at least one nontraditional parking space, the method comprising the steps of:

obtaining parking information related to the at least one nontraditional parking space having a vehicle parked within the at least one nontraditional parking space, wherein the parking information includes a location of the at least one nontraditional parking space;

determining a confidence interval that the at least one nontraditional parking space is an actual parking space based on a number of vehicles that have utilized the at least one nontraditional parking space;

generating a directory of the at least one nontraditional parking space, the directory including the location of the parking space and the confidence interval associated with the at least one nontraditional parking space; and wherein the at least one nontraditional parking space is a parking space for a vehicle that does not have an indicator indicating that the at least one nontraditional parking space is an actual parking space.

10. The method of claim 9, further comprising the steps of transmitting the location of the at least one nontraditional parking space and the confidence interval associated with the at least one nontraditional parking space to a vehicle.

11. The method of claim 9, further comprising the steps of:

determining a first reference location of a first reference object;

determining a second reference location of a second reference object; and determining the location of the at least one nontraditional parking space based on the first reference location and the second reference location.

12. The method of claim 11, further comprising the step of:

determining a confidence rating of the location of the at least one nontraditional parking space based on an object class of the first reference object or the second reference object.

13. The method of claim 12, wherein the object class includes at least one of an infrastructure class, a fixed structure class, and a dynamic structure class.

14. The method of claim 9, wherein the parking information includes an identifier identifying the vehicle parked within the at least one nontraditional parking space.

15. The method of claim 14, further comprising the step of determining the confidence interval based on a number of different vehicles that have utilized the at least one nontraditional parking space.

16. A non-transitory computer-readable medium for detecting at least one nontraditional parking space and including instructions that when executed by one or more processors cause the one or more processors to:

obtain parking information related to the at least one nontraditional parking space having a vehicle parked within the at least one nontraditional parking space, wherein the parking information includes a location of the at least one nontraditional parking space;

determine a confidence interval that the at least one nontraditional parking space is an actual parking space based on a number of vehicles that have utilized the at least one nontraditional parking space;

generate a directory of the at least one nontraditional parking space, the directory including the location of the at least one nontraditional parking space and the confidence interval associated with the at least one nontraditional parking space; and wherein the at least one nontraditional parking space is a parking space for a vehicle that does not have an indicator indicating that the at least one nontraditional parking space is an actual parking space.

17. The non-transitory computer-readable medium of claim 16, further including instructions that when executed by one or more processors cause the one or more processors to transmit the location of the at least one nontraditional parking space and the confidence interval associated with the at least one nontraditional parking space to a vehicle.

18. The non-transitory computer-readable medium of claim 16, further including instructions that when executed by one or more processors cause the one or more processors to:

determine a first reference location of a first reference object;

determine a second reference location of a second reference object; and determine the location of the at least one nontraditional parking space based on the first reference location and the second reference location.

19. The non-transitory computer-readable medium of claim 18, further including instructions that when executed by one or more processors cause the one or more processors to determine a confidence rating of the location of the at least one nontraditional parking space based on an object class of the first reference object or the second reference object.

20. The non-transitory computer-readable medium of claim 19, wherein the object class includes at least one of an infrastructure class, a fixed structure class, and a dynamic structure class.

* * * * *